US006302830B1

(12) United States Patent
Stearns

(10) Patent No.: US 6,302,830 B1
(45) Date of Patent: Oct. 16, 2001

(54) EXERCISE METHODS AND APPARATUS

(76) Inventor: Kenneth W. Stearns, P.O. Box 55912, Houston, TX (US) 77255

( * ) Notice: Subject to any disclaimer, the term of this patent is extended or adjusted under 35 U.S.C. 154(b) by 0 days.

(21) Appl. No.: 09/570,278

(22) Filed: May 12, 2000

(51) Int. Cl.[7] ..... A63B 69/16
(52) U.S. Cl. ..... 482/70; 482/51; 482/52
(58) Field of Search ..... 482/51–52, 57, 482/70, 53, 62, 71, 79, 80

(56) References Cited

U.S. PATENT DOCUMENTS

| | | | | |
|---|---|---|---|---|
| 219,439 | | 9/1879 | Blend . | |
| 1,909,190 | | 5/1933 | Sachs . | |
| 2,772,881 | * | 12/1956 | Fundom | 482/51 |
| 3,316,898 | | 5/1967 | Brown . | |
| 3,408,067 | | 10/1968 | Armstrong . | |
| 3,475,021 | | 10/1969 | Ruegsegger . | |
| 3,824,994 | | 7/1974 | Soderberg, Sr. . | |
| 3,941,377 | | 3/1976 | Lie . | |
| 3,970,302 | | 7/1976 | McFee . | |
| 4,023,795 | | 5/1977 | Pauls . | |
| 4,185,622 | | 1/1980 | Swenson . | |
| 4,496,147 | | 1/1985 | DeCloux et al. . | |
| 4,685,666 | | 8/1987 | DeCloux . | |
| 4,709,918 | | 12/1987 | Grinblat . | |
| 4,733,858 | | 3/1988 | Lan . | |
| 4,786,050 | | 11/1988 | Geschwender . | |
| 4,804,178 | | 2/1989 | Friedebach . | |
| 4,951,942 | | 8/1990 | Walden . | |
| 4,993,704 | | 2/1991 | Luczynski . | |
| 5,000,442 | | 3/1991 | Dalebout et al. . | |
| 5,195,935 | | 3/1993 | Fencel | 482/70 |
| 5,242,343 | | 9/1993 | Miller | 482/57 |
| 5,279,529 | | 1/1994 | Eschenbach | 482/57 |
| 5,290,211 | | 3/1994 | Stearns | 482/70 |
| 5,299,993 | | 4/1994 | Habing | 482/51 |
| 5,336,141 | | 8/1994 | Vittone | 482/51 |
| 5,401,226 | | 3/1995 | Stearns | 482/53 |
| 5,429,567 | * | 7/1995 | Gorschefske et al. | 482/70 |
| 5,499,956 | | 3/1996 | Habing et al. | 482/52 |
| 5,575,740 | | 11/1996 | Piaget et al. | 482/70 |
| 5,735,773 | | 4/1998 | Vittone et al. | 482/52 |
| 5,779,599 | | 7/1998 | Chen | 482/57 |
| 5,792,029 | | 8/1998 | Gordon | 482/52 |
| 5,803,872 | * | 9/1998 | Chang | 482/52 |
| 5,820,524 | * | 10/1998 | Chen | 482/51 |
| 5,833,584 | | 11/1998 | Piaget et al. | 482/70 |
| 5,967,944 | | 10/1999 | Vittone et al. | 482/52 |
| 6,019,709 | | 2/2000 | Piaget | 482/70 |
| 6,099,439 | * | 8/2000 | Ryan et al. | 482/51 |
| 6,142,915 | * | 11/2000 | Eschenbach | 482/57 |

* cited by examiner

*Primary Examiner*—Jerome W. Donnelly

(57) ABSTRACT

An exercise apparatus has left and right foot skates which are constrained to move back and forth in reciprocal fashion. Left and right foot platforms are movably mounted on respective foot skates and constrained to move up and down in reciprocal fashion. The apparatus may be operated in different modes of operation, including a first mode, wherein the foot skates are free to move back and forth and the foot platforms are free to move up and down; a second mode, wherein the foot platforms are free to move up and down, but the foot skates are locked against movement; and a third mode, wherein the foot skates are free to move back and forth, but the foot platforms are locked against movement. Resistance may be provided to back and forth movement of the foot skates and/or up and down movement of the foot platforms.

40 Claims, 9 Drawing Sheets

Fig. 10
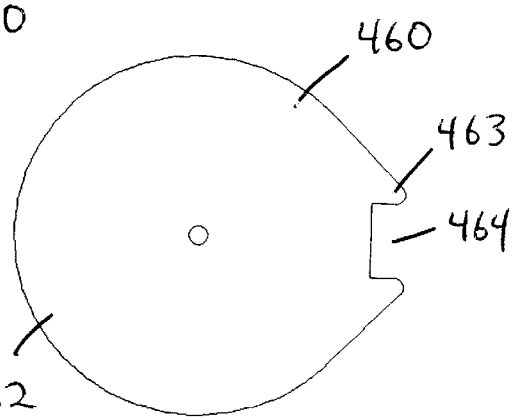
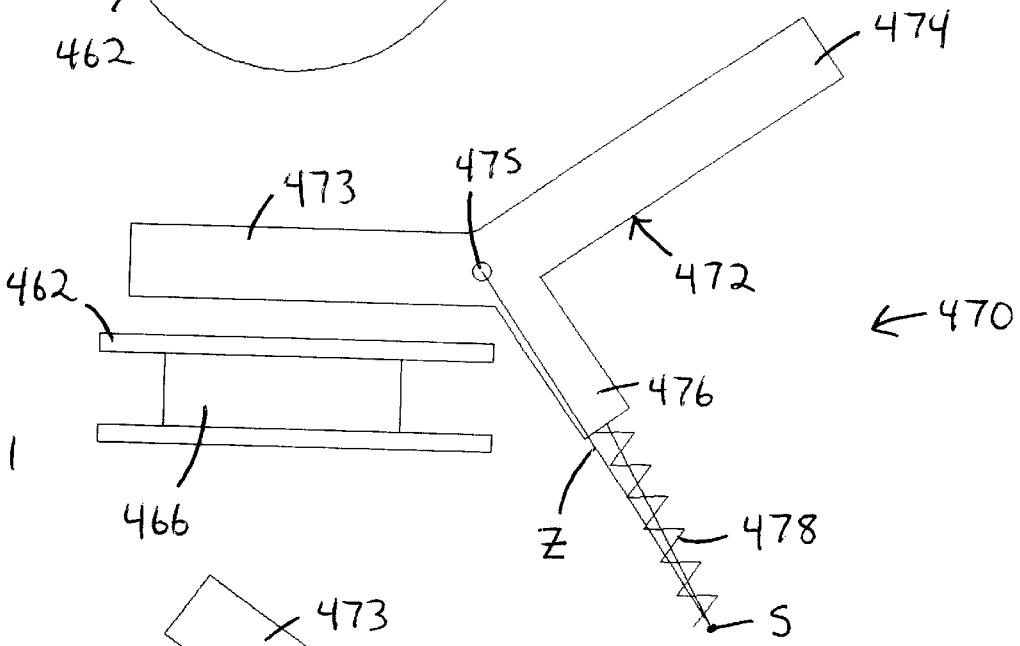
Fig. 11
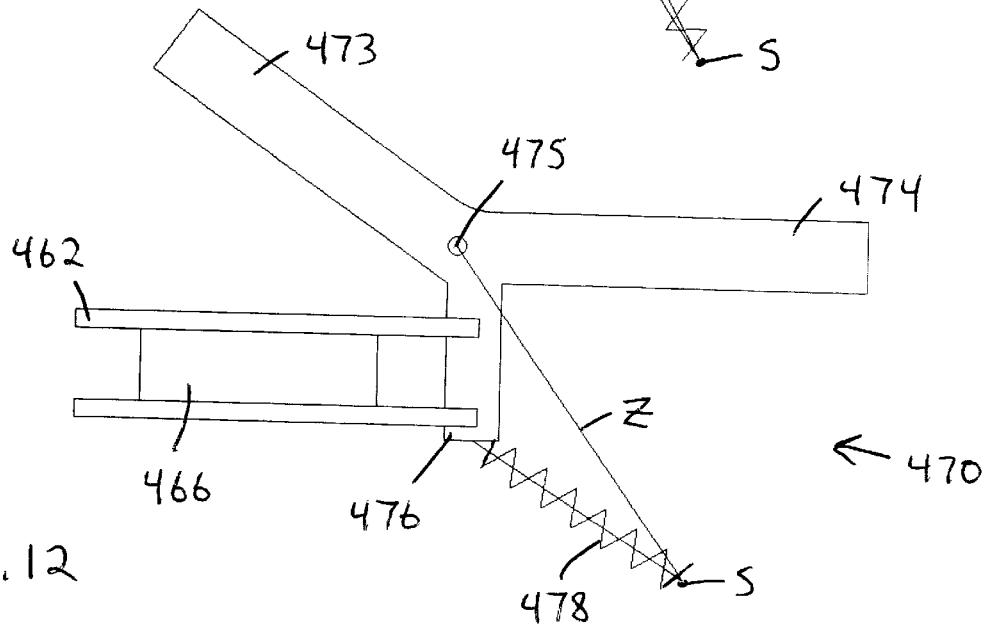
Fig. 12

EXERCISE METHODS AND APPARATUS

FIELD OF THE INVENTION

The present invention relates to exercise methods and apparatus and more particularly, to exercise equipment which facilitates foot travel through various paths.

BACKGROUND OF THE INVENTION

Exercise equipment has been designed to facilitate a variety of lower body exercise motions. For example, treadmills allow a person to walk or run in place; stepper machines allow a person to climb in place; bicycle machines allow a person to pedal in place; other machines allow a person to skate and/or stride in place; and still other machines guide a person's feet through elliptical paths of travel. Yet another exercise apparatus, disclosed in U.S. Pat. No. 5,290,211 to Stearns, is designed to facilitate several different exercise motions, including free form paths of foot movement and controlled paths of foot movement comparable to walking, running, stepping, cycling, striding, skiing, and/or elliptical motion.

SUMMARY OF THE INVENTION

Among other things, the present invention provides an exercise apparatus which facilitates a natural walking motion like a treadmill but with greater flexibility and/or less potential for injury. In this regard, left and right foot supports are pivotally mounted on left and right skates. The skates are movable back and forth relative to a base, and the foot supports are movable up and down relative to the skates. As a result, a person's feet are supported throughout a natural striding motion. Moreover, both the length of each stride and the speed of foot motion may be varied at the discretion of the user.

On a preferred embodiment, the foot supports are disposed above a deck, which provides a stable surface for mounting and dismounting the foot platforms, and which also shrouds the skates and associated linkage components. Bars extend through slots in the deck to connect the foot supports to the skates. The skates are constrained to move back and forth in reciprocal fashion, and the foot platforms are constrained to move up and down in reciprocal fashion. Rearward movement of the skates causes a flywheel to rotate subject to variable resistance. Resistance devices are also interconnected between the foot platforms and the skates to resist downward pivoting of the former relative to the latter. The entire foot supporting assembly is mounted on a base which may be pivoted relative to a forward stanchion to facilitate storage and/or transportation of the preferred embodiment machine.

Another aspect of the present invention is to facilitate various modes of exercise motion involving left and right foot supports movably mounted on a base. In a first mode of operation, the foot supports are free to move both back and forth and up and down relative to the base. In a second mode of operation, the foot supports are free only to move up and down relative to the base, in a manner similar to a stair-stepping motion. In a third mode of operation, the foot supports are free only to move back and forth relative to the base, in a manner similar to a skiing motion. In each of the these modes of operation, a person's feet are supported throughout the exercise motion, and there is virtually no impact on the person's joints. If total body exercise is desired, handles may be movably mounted on the base and linked to the foot linkage assemblies. Many features, advantages, and variations, of the present invention may become apparent from the more detailed description that follows.

BRIEF DESCRIPTION OF THE DRAWING

The present invention is described with reference to the following figures, wherein like numerals represent like parts and assemblies throughout the several views:

FIG. 10 is a top view of a pulley suitable for use in connection with the linkage assembly of FIGS. 6–7 and an alternative locking assembly;

FIG. 11 is a diagrammatic side view of a toggle switch locking assembly shown in a disengaged orientation relative to the pulley of FIG. 10; and FIG. 12 is a diagrammatic side view of the toggle switch locking assembly of FIG. 11 shown in an engaged orientation relative to the pulley of FIG. 10.

DESCRIPTION OF THE PREFERRED EMBODIMENT

Figure 1:
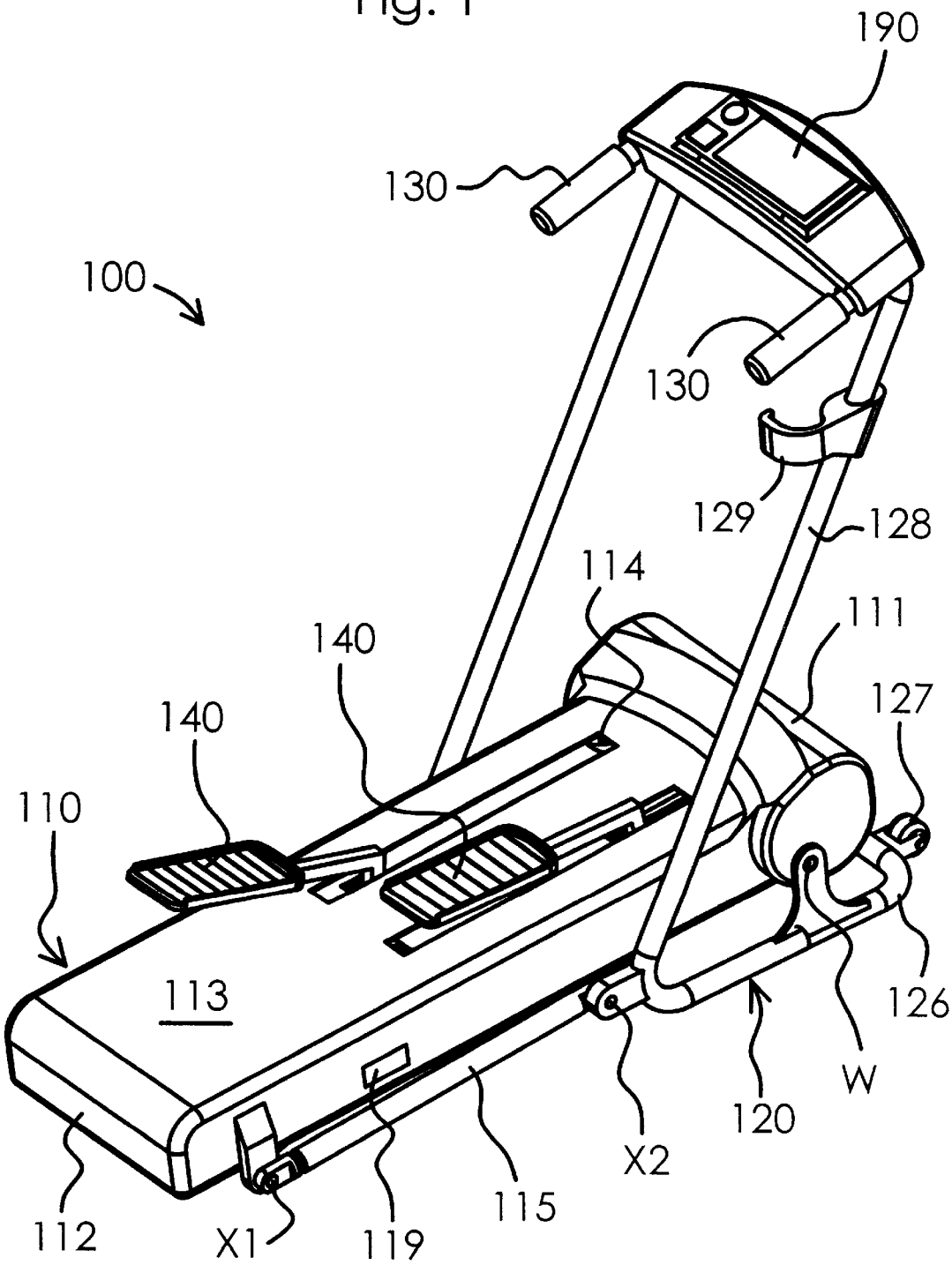
FIG. 1 is a perspective view of an exercise apparatus constructed according to the principles of the present invention.
Figure 2:
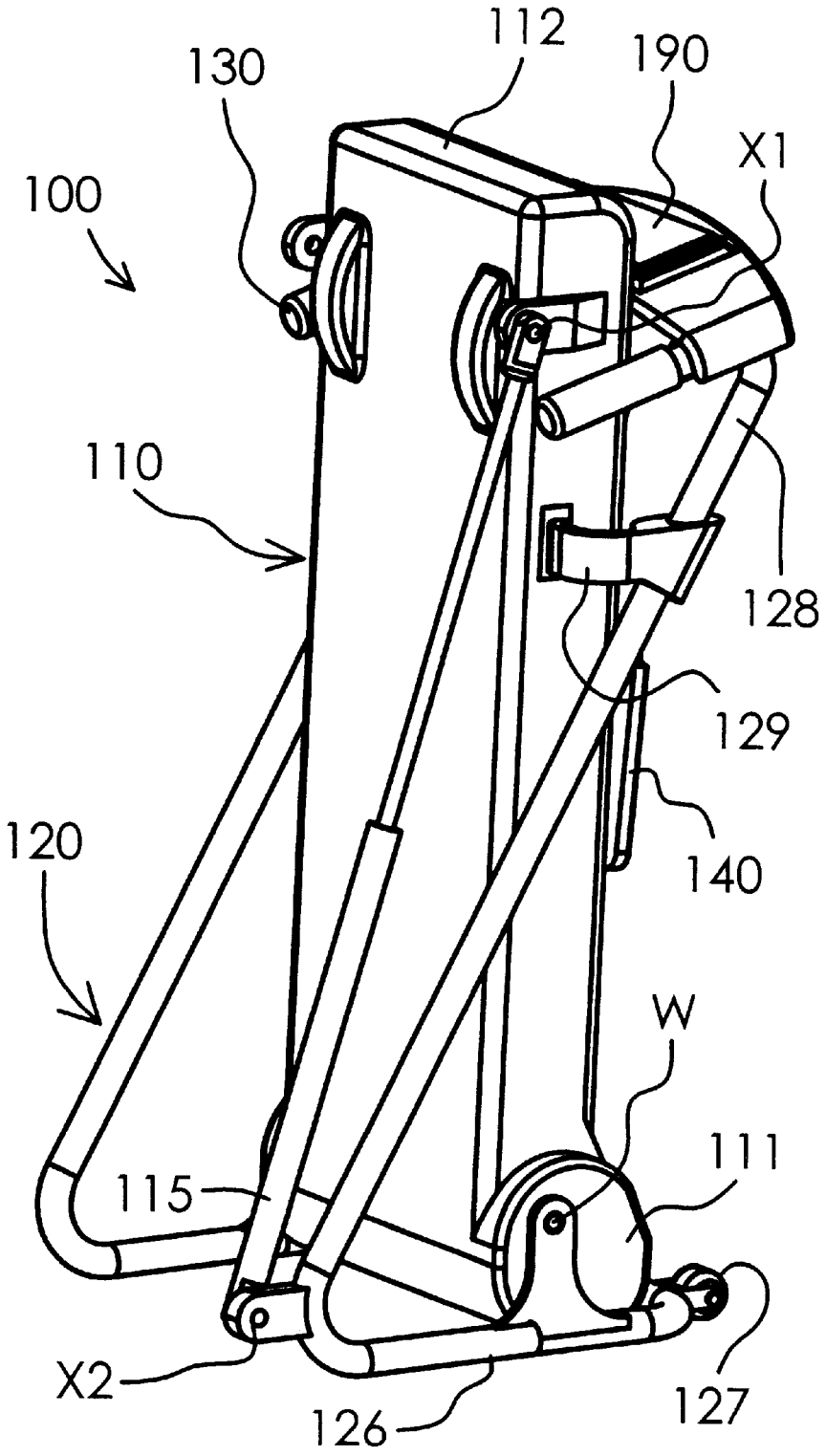
FIG. 2 is a perspective view of the exercise apparatus of FIG. 1 folded into a storage configuration.
Figure 4:
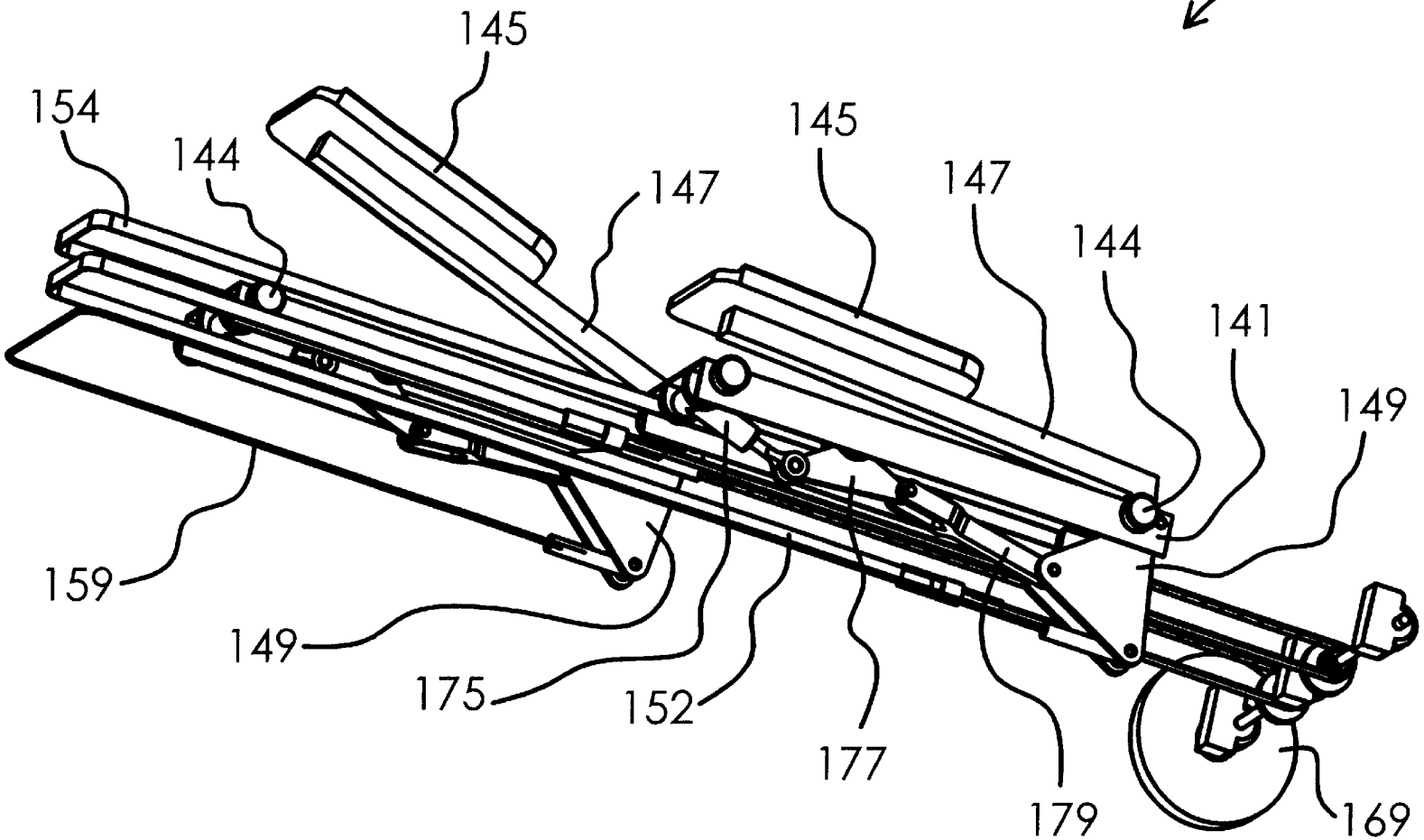
FIG. 4 is another perspective view of the linkage assembly of FIG. 3.
Figure 5:
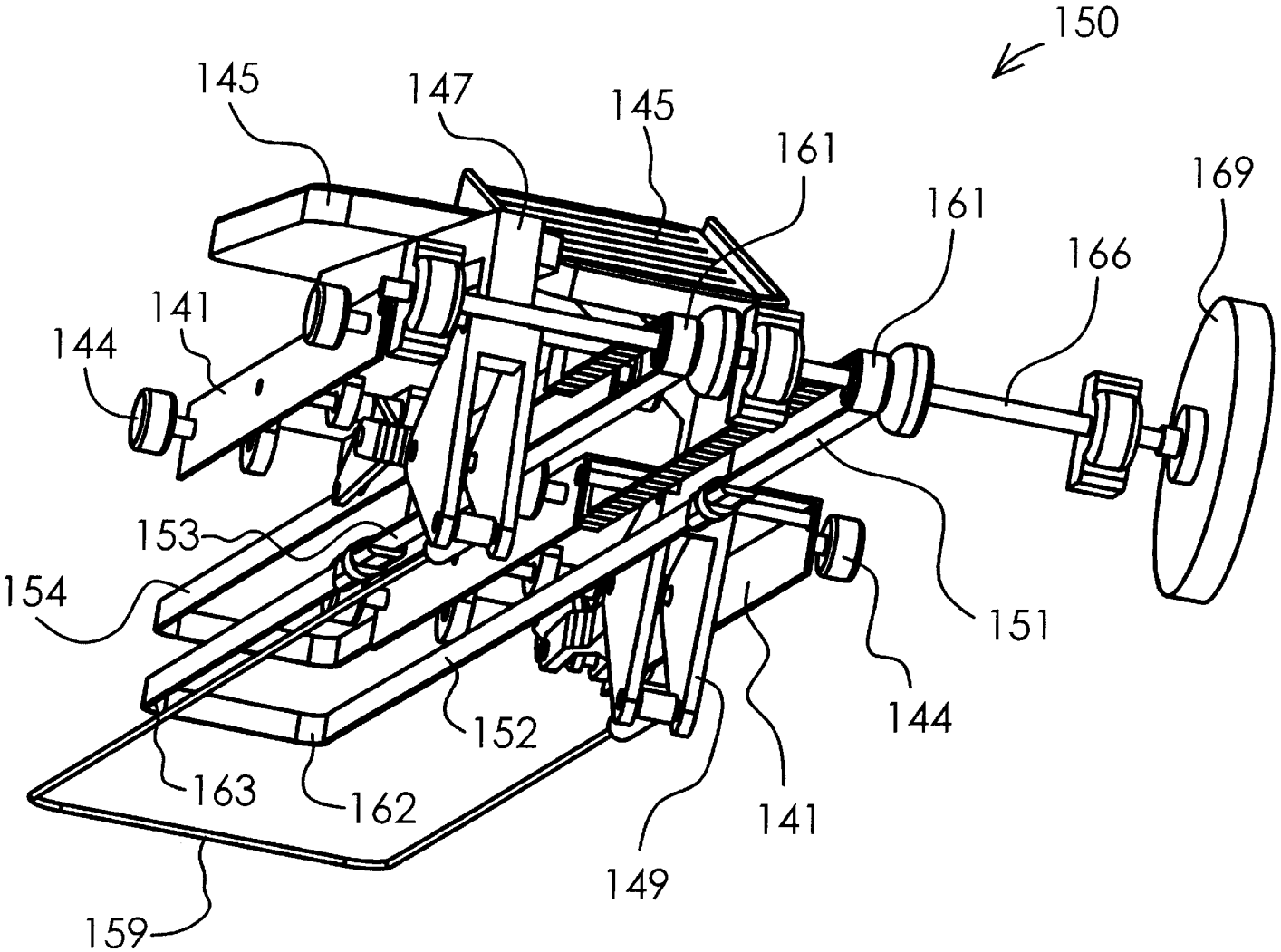
FIG. 5 is yet another perspective view of the linkage assembly of FIG. 3.

A preferred embodiment of the present invention is designated as 100 in FIGS. 1–2. The exercise apparatus 100 includes a base 110, a floor engaging support frame 120 connected to the base 110, two stationary handles 130 mounted on the support frame 120, and two foot supporting members 140 movably mounted relative to the base 110 via a linkage assembly 150 shown in FIGS. 3–5. The apparatus 100 is generally symmetrical about a vertical plane extending longitudinally through the center of the base 110, and like reference numerals are used to designate both the "right-hand" and "left-hand" parts.

The base 110 is a shroud or housing which extends from a forward end 111 to a rearward end 112. The base 110 provides an upwardly facing deck 113 that is sufficiently strong and spacious to support a person in a standing position rearward of the foot supporting members 140. Left and right, longitudinally extending slots 114 are provided in the deck 113 for reasons discussed below. The frame 120 includes a floor engaging portion 126 which is rotatably connected to the base 110 at a pivot axis W and maintains the forward end 111 of the base 110 above the floor surface. A spring-loaded extension member 115 has a rearward end rotatably connected to a rearward portion of the base 110 at a first pivot axis X1, and a forward end rotatably connected to a rearward portion of the frame 120 at a second pivot axis X2. The extension member 115 is compressed between the base 110 and the frame 120 and urges the rearward end 112 of the base 110 upward once the axis X1 is moved above a line drawn between the axis X2 and the axis W.

The frame 120 also includes an upright portion or stanchion 128 which extends upward from the floor engaging portion 126. The distal ends of the stanchion 128 are bent rearward to provide fixed handles 130. A user interface device 190 is mounted on top of the stanchion 128 to provide information regarding the apparatus 100 and/or a person's performance while using the apparatus 100. A leaf-spring latch 129 is mounted on one side of the stanchion 128 and arranged to snap into a recess or cavity 119 on the base 110 when the latter is rotated to a vertical orientation (as shown in FIG. 2). The handles 130 are spaced far enough apart to accommodate the rear end 112 of the base 110 therebetween, and the open design of the stanchion 128 accommodates the foot supporting members 140, as well.

Wheels 127 are rotatably mounted on the forward end of the frame 120 to facilitate movement of the apparatus 100 across a floor surface. In both FIGS. 1 and 2, the wheels 127 are disposed slightly above the floor surface, and thus, the apparatus 100 must be tilted forward to bring the wheels 127 into contact with the floor surface. A similar wheel arrangement could be provided on the rearward end of the frame 120, if it would be preferable to tilt the apparatus in the opposite direction.

Each of the foot supporting members 140 includes a skate 141 and a foot platform 145 (a modified skate is designated as 141' in FIG. 3 for reasons discussed below). Rollers 144 are rotatably mounted on opposite sides of each skate 141, and tracks 104 are provided on the base 110 to receive and guide the rollers 144. In other words, the skates 141 are supported by the base 110 and movable back and forth relative thereto. Flexible connectors 151–154 are interconnected between the skates 141 and routed relative to the base 110 in such a manner that the skates 141 are constrained to move back and forth in reciprocal fashion relative to the base 110.

The connectors 151–153 link rearward movement of the skates 141 to rotation of a flywheel shaft 166 and associated flywheel 169. In this regard, at least the distal connectors 151 and 153 are timing belts having ridges which register with notches or teeth on respective one-way clutch mechanisms 161 on the shaft 166. Other types of linkage arrangements, including chains or repeatedly wrapped cords, may be used in lieu of timing belts. The intermediate cable segment 152 is interconnected between the distal segments 151 and 153 and routed about two pulleys or other guides which occupy the positions designated as 162 and 163 in FIG. 5. The other cable segment 154 is similarly routed about two similar, axially aligned guides on the base 110. The flywheel 169 may be "stepped-up" and/or subjected to any of several known resistance devices as a matter of design choice.

On each side of the apparatus 100, an L-shaped bar 147 has a relatively longer segment which is disposed above the deck 113 and supports a foot platform 145, and a relatively shorter segment which extends through a slot 114 in the deck 113 and is connected to a triangular plate or yoke 149. A first vertex of the plate 149 is pivotally mounted to the skate 141. A second vertex of the plate 149 is connected to a flexible connector 159, as further explained below. A third vertex of the plate 149 is pivotally connected to a forward end of a connector link 179. An opposite, rearward end of the connector link 179 is pivotally connected to a forward end of a triangular rocker link 177. An intermediate portion of the rocker link 177 is pivotally connected to the skate 141. A rearward end of the rocker link 177 is pivotally connected to a resistance device 175.

On the preferred embodiment 100, the resistance device 175 is a combination shock absorber and spring having a relatively forward, rod portion which telescopes relative to a relatively rearward, cylinder portion. An example of such a device is disclosed in U.S. Pat. No. 5,072,928 to Stearns, which is incorporated herein by reference. Other suitable resistance devices, including a block of rubber, may be used in the alternative. Moreover, the spring may be provided in lieu of or apart from the shock absorber, and arranged in other suitable ways relative to the other components. An advantage of the depicted embodiment 100 is that the parts are arranged to provide progressively increasing resistance to downward movement of the foot platform 145. In this regard, the rocker link 177 pivots about a first axis relative to the skate 141; the connector link 179 pivots about a second axis relative to the plate 149; and the connector link and the rocker link 177 define a third pivot axis which moves toward a line drawn between the first axis and the second axis, as the foot platform 145 moves downward relative to the skate 141 (thereby decreasing the mechanical advantage or moment arm of the connector link 179 relative to the rocker link 177). Also, the resistance device 175 pivots about a fourth axis relative to the skate 141; and the resistance device 175 and the rocker link 177 define a fifth pivot axis which moves away from a line drawn between the first axis and the second axis, as the foot platform 145 moves downward relative to the skate 141 (thereby increasing the mechanical advantage or moment arm of the resistance device 175 relative to the rocker link 177).

The cable 159 is interconnected between each said plate 149 and is routed about similar pulleys or guides near the rear end of the base 110. The cable 159 causes either of the foot platforms 145 to move upward in response to downward movement of the other foot platform 145, and cooperates with gravity acting on the person's body to constrain the foot platforms 145 to move up and down in reciprocal fashion relative to the base 110.

With the skates 141 free to move back and forth relative to the base 110, and the foot platforms 145 free to move up and down relative to the skates 141, the apparatus 100 facilitates unrestricted foot movement through various types and sizes of paths having horizontal and/or vertical components. The apparatus 100 may also be readily modified in various ways to provide more restricted forms of exercise motion. For example, FIG. 3 shows an optional knob 108 protruding from a side of the base 110 and operable to selectively lock the skates 141 and 141' against movement relative to the base 110 (without impeding up and down movement of the foot platforms 145). In this regard, a locking pin projects inward from the knob 108 and through a hole in the base 110, and a compressed helical spring biases the pin toward the right skate 141'. When the knob 108 occupies a first orientation, the locking pin is held in a relatively outward position, clear of the right skate 141'. When the left and right skates 141 and 141' are arranged side by side, and the knob 108 is rotated to a second orientation, the locking pin is urged inward into an aligned hole in the right skate 141'.

Figure 3:
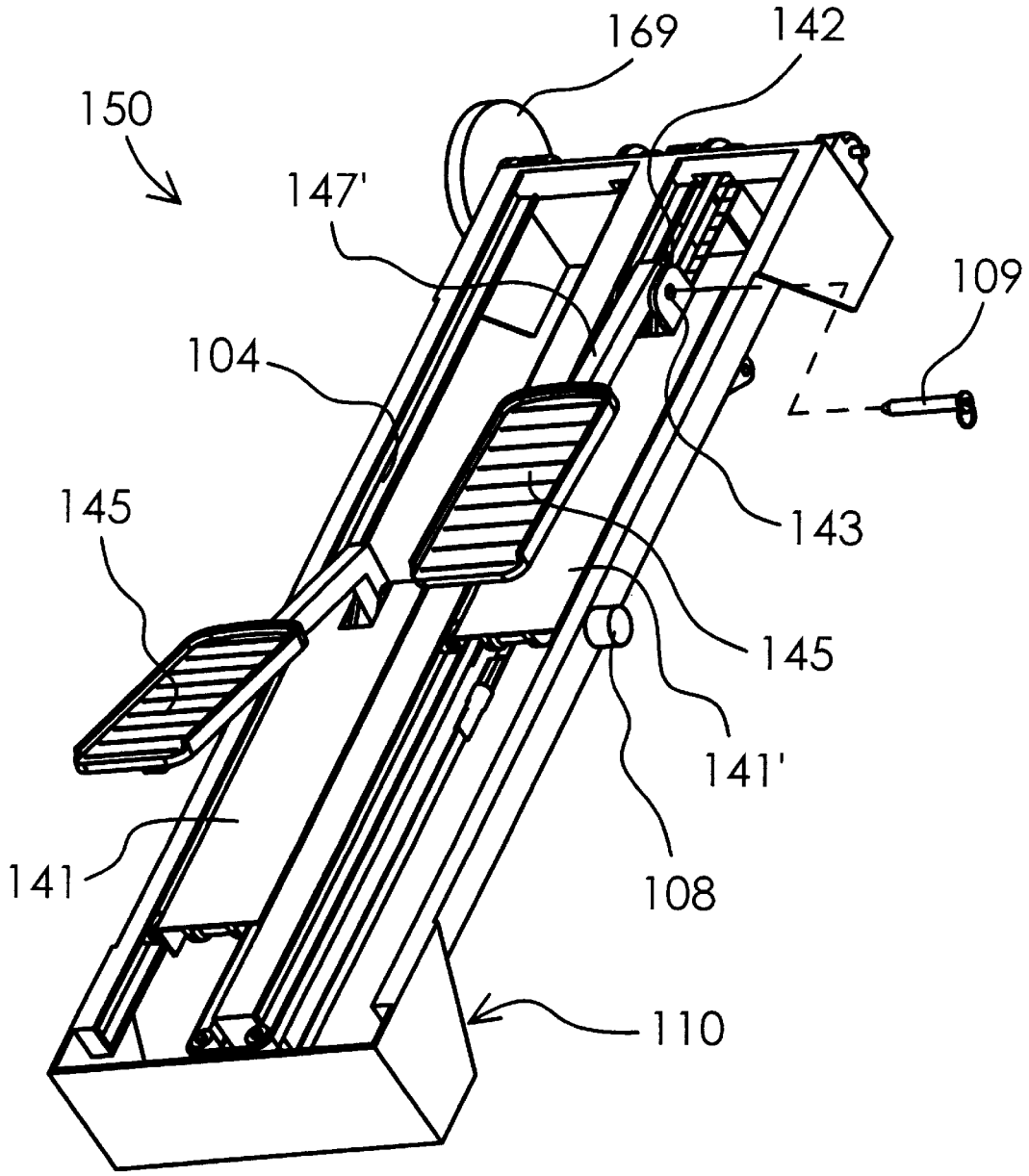
FIG. 3 is a perspective view of the linkage assembly on the exercise apparatus of FIG. 1.

FIG. 3 also shows an optional detent pin 109 which is operable to selectively lock the foot platforms 145 against movement relative to the skates 141 and 141' (without impeding back and forth movement of the skates 141 and 141'). In this regard, the pin may be inserted into a hole 143 in an optional bracket 142 on the right skate 141' and into a similar hole in the bar 147' (when the foot platforms 145 occupy identical elevations).

Figure 6:
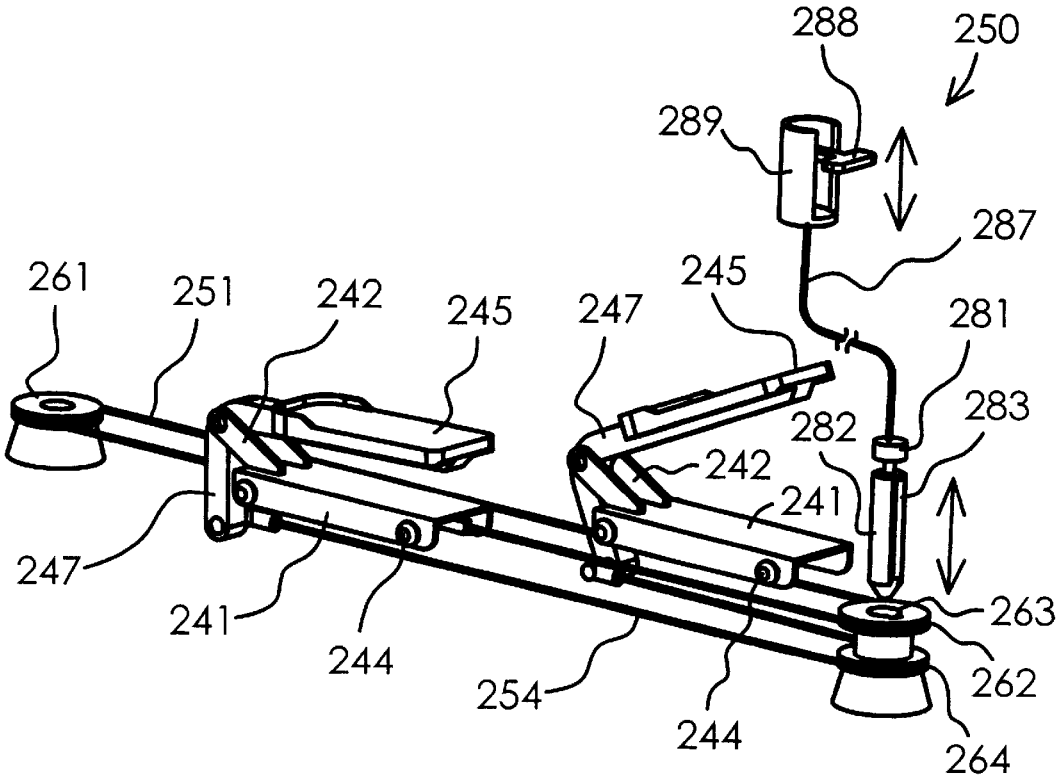
FIG. 6 is a perspective view of another linkage assembly constructed according to the principles of the present invention.
Figure 7:
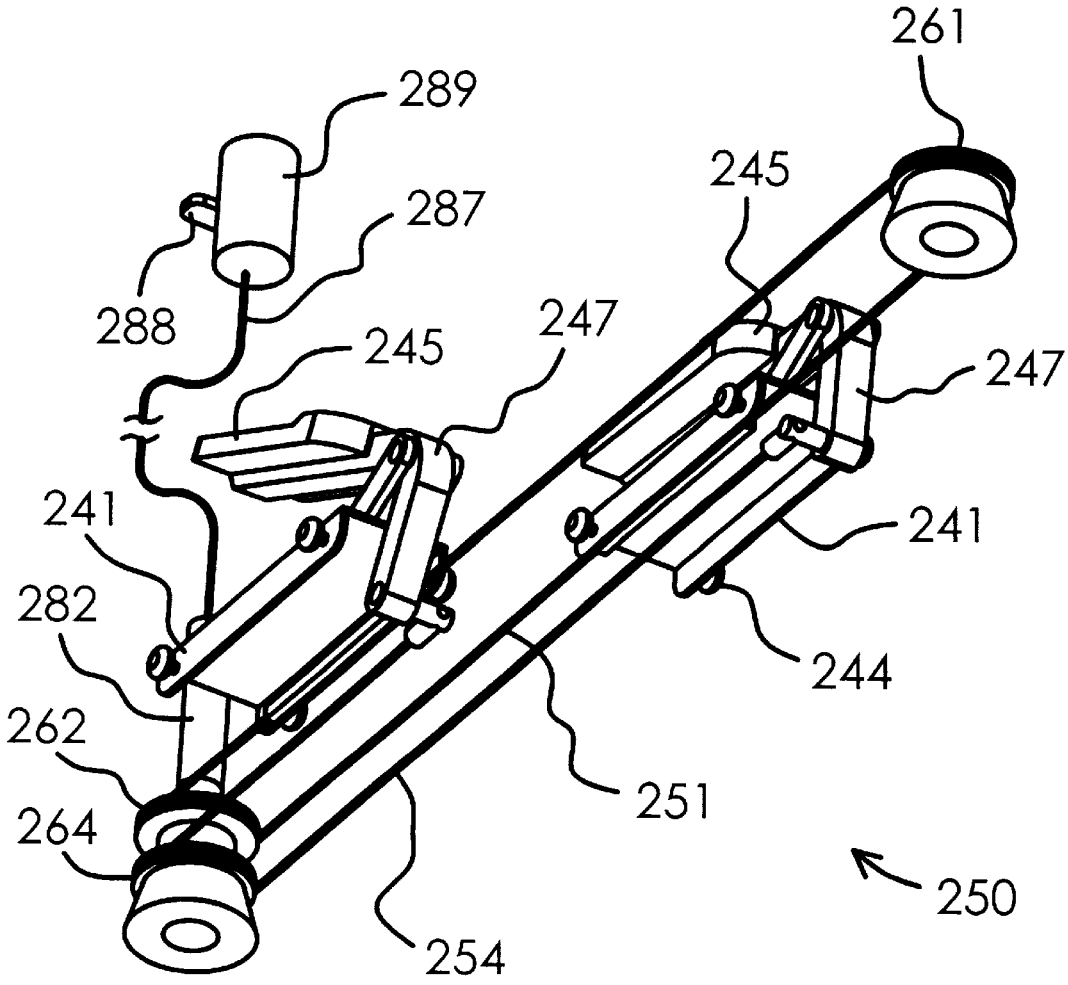
FIG. 7 is another perspective view of the linkage assembly of FIG. 6.

An alternative linkage assembly is designated as 250 in FIGS. 6–7. The linkage assembly 250 provides an alternative means for selecting between the different modes or types of foot motion, and it is suitable for use by itself or in conjunction with the linkage assembly 150 (in lieu of the arrangement shown with reference to the skate 141' in FIG. 3). For example, this alternative selecting means may be implemented on any two axially aligned pulleys associated with the cables 154 and 159, respectively. The assembly 250 is shown without any resistance devices simply to emphasize that the present invention should not be limited one way or the other. Among other things, a person's body weight, the inherent drag in the system, and the reciprocal nature of the foot motion may cooperate to impose a sufficient level of resistance to exercise. Moreover, a flywheel and any desired flywheel resistance device may be operatively connected to one or both of the pulleys 262 and 264.

Rollers 244 are rotatably mounted on opposite sides of the skates 241 to engage tracks similar to the those on the preferred embodiment base 110. A continuous loop of cable 251 has a first portion secured to the left skate 241, a second portion routed about a forward pulley 261, a third portion secured to the right skate 241, and a fourth portion routed about a rearward pulley 262 (and returning to the left skate 241). The second and fourth cable portions are wrapped multiple times about respective pulleys 261 and 262 to ensure that back and forth movement of the skates 241 is linked to rotation of the pulleys 261 and 262. As a result of this arrangement, the skates 241 are constrained to move back and forth in reciprocal fashion.

On each side of the assembly 250, an L-shaped member 247 has a relatively longer segment disposed above the skate 241 and supporting a foot platform 245, and a relatively shorter segment extending downward in front of the skate 241. A trunnion 242 extends upward and forward from the skate 241 to rotatably support the member 247 proximate the juncture between the longer segment and the shorter segment. A cord 254 is interconnected between the distal end of each said shorter segment and routed about a pulley 264 disposed beneath the pulley 262. This cord 254 is similarly wrapped multiple times about the pulley 264 to ensure that up and down movement of the foot platforms 245 is linked to rotation of the pulley 264. As a result of this arrangement, the foot platforms 245 are constrained to move up and down in reciprocal fashion. Various types of resistance means, including the arrangement shown on the linkage assembly 150, may be interconnected between the foot platforms 245 and the skates 241 to resist downward pivoting of the former relative to the latter.

The alternative selecting means includes an adjustment member 282 having an axially extending ridge or key 283, thereby giving the member 282 a non-circular cross-section. The adjustment member 282 is rotatably and slidably mounted on a support member 281, which is preferably a linear actuator anchored relative to the base (not shown). The adjustment member 282 is connected to a controller 289 by means of a wire 287. The controller 289 includes a lever 288 or other suitable input device which may be incorporated into a user interface like that designated as 190 in FIGS. 1–2. The member 282 is selectively movable relative to the base and into a keyway 263 in the pulley 262 and/or a similar keyway in the pulley 264. The key 283 on the adjustment member 282 interengages a similar keyway on the base when disposed entirely above the lower pulley 264.

Movement of the lever 288 causes movement of the adjustment member 282 with the following effects: (a) when the adjustment member 282 occupies an uppermost position, clear of both pulleys 262 and 264 (as shown in FIG. 6), the skates 241 are free to move relative to the base, and the foot platforms 245 are free to move relative to respective skates 241, thereby facilitating free form motion having any desired horizontal component and any desired vertical component; (b) when the skates 241 are positioned side by side, and the adjustment member 282 is inserted into only the upper pulley 262, the key 283 remains engaged with the base and prevents rotation of the upper pulley 262, thereby preventing back and forth movement of the skates 241, and limiting foot movement to a stepping motion involving up and down pivoting of the foot platforms 245; and (c) when the adjustment member 282 is inserted through both pulleys 262 and 264, the key 283 disengages the base, and the pulleys 262 and 264 are constrained to rotate together, thereby preventing relative motion of the foot platforms 245 relative to respective skates 241, and limiting foot movement to a skiing motion involving back and forth travel of the foot platforms 245 and the skates 241.

Figure 8:
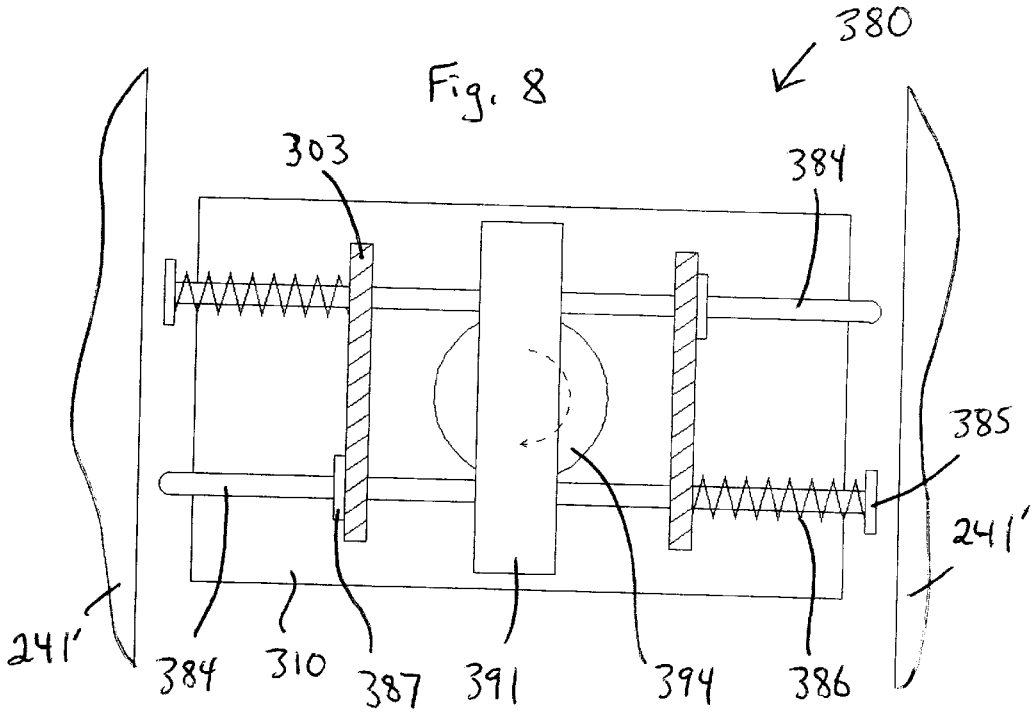
FIG. 8 is a partially sectioned top view of a locking assembly suitable for use in connection with the foregoing linkage assemblies.
Figure 9:
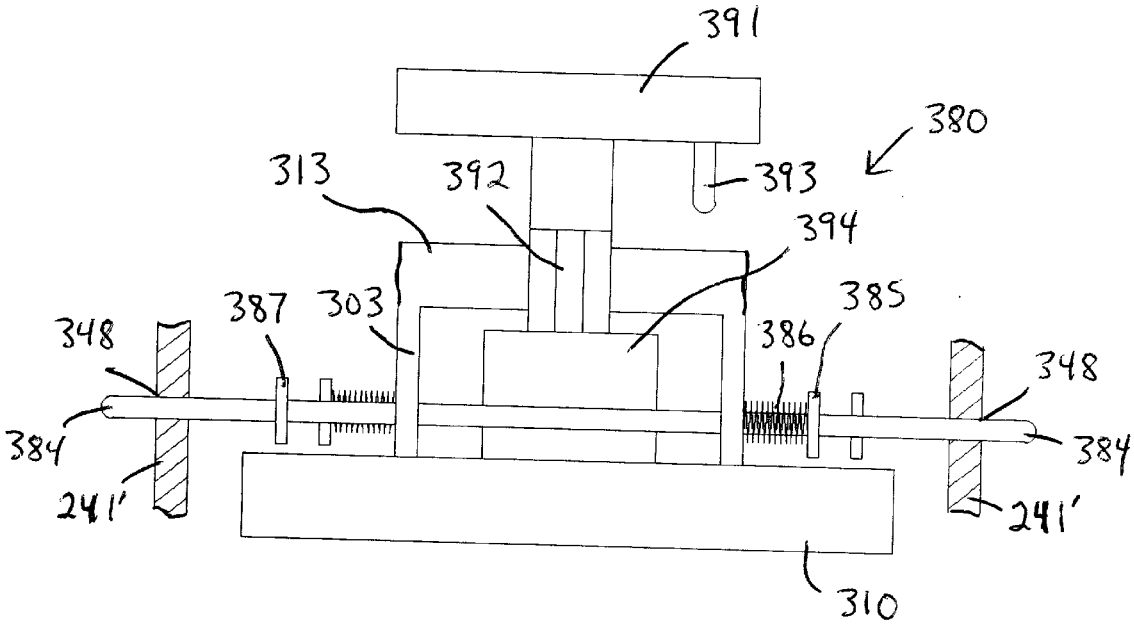
FIG. 9 is a side view of the locking assembly of FIG. 8.

FIGS. 8–9 show an alternative means or assembly 380 suitable for locking foot skates 241' against movement relative to base 310. The base 310 includes an upwardly facing deck 313 which is preferably supported by intermediate braces 303. First and second rods 384 extend laterally through holes in the braces 303. A head 385 is provided on an end of each rod 384, and an opposite end of each rod is rounded. The rods 384 are arranged so that the heads 385 are disposed on opposite sides of the braces 303. A helical coil spring 386 is disposed on each rod 384 and compressed between a respective head 385 and a respective brace 303. An intermediate stop 387 is provided on each rod 384, proximate the rounded end thereof, to resist passage through the brace 303 opposite the spring 386.

Each rod 384 is provided with gear teeth which face toward an opposite rod 384 and engage a pinion gear 394 rotatably mounted on the base 310 between the rods 384. As a result, the rods 384 are constrained to move in opposite directions in response to rotation of the gear 394. A keyed member 392 projects into the gear 394 and is constrained to rotate together therewith. The keyed member 392 protrudes through the deck 313 and is rigidly secured to a T-shaped handle 391. The handle 391 and the keyed member 392 are movable axially relative to the gear 394 and the deck 313. A pin 393 is mounted on one end of the handle 391 and extends toward the deck 313. When the handle 391 occupies the orientation shown in FIG. 8, the pin 393 is insertable into a first hole in the deck 313, and the rods 384 remain clear of the skates 241'. When the handle 391 occupies the orientation shown in FIG. 9, the pin 393 is insertable into a second hole in the deck 313, and the rods 384 extend through holes 348 in the skates 241', thereby preventing back and forth movement of same. In either orientation, the handle 391 occupies an essentially flush position relative to the deck 313.

FIGS. 10–12 show an alternative assembly or means 470 suitable for locking left and right foot platforms 245 against movement relative to respective foot skates 241. The cable 254 is routed about the pulley 460 shown in FIG. 10, rather than the pulley 264 shown in FIGS. 6–7. The pulley 460 includes a hub 466 disposed between upper and lower flanges 462. Each of the flanges 462 includes a radially extending, eccentric portion 463 having a notch 464 formed therein.

A toggle switch or lever 472 is rotatably mounted to a base, which may be similar to the preferred embodiment base 110, in proximity to the pulley 460. The switch 472 rotates about a pin 475 which extends perpendicular to the rotational axis of the pulley 460. The switch 472 includes a first distal arm 473 and a second distal arm 474 which are disposed on opposite sides of the pin 475. The arms 473 and 474 define an angle of approximately 150° therebetween. As a result, when the arm 473 lies flush with the deck on the base, the arm 474 extends upward relative to the deck at an angle of approximately 30°, and similarly, when the arm 474 lies flush with the deck on the base, the arm 473 extends upward relative to the deck at an angle of approximately 30°. A third, relatively smaller arm 476 extends perpendicularly away from the second arm 474, proximate its juncture with the first arm 473. The third arm or latch 476 is sized and configured to fit within the notches 464 in the pulley 460, and a helical coil spring 478 is compressed between the base and the distal end of the latch 476.

When the switch 472 occupies the orientation shown in FIG. 11, the first arm 473 is flush with the deck, and the third arm or latch 476 is clear of the pulley 460. The spring 478 is disposed to the right of a line Z drawn between the pin 475 and the far end S of the spring 478. As a result, the spring 478 biases the switch 472 to remain in this orientation. When force, sufficient to overcome the spring bias, is exerted against the second arm 474, the spring 478 crosses over the line Z and urges the switch 472 toward the orientation shown in FIG. 12. When the switch 472 occupies the orientation shown in FIG. 12, the second arm 474 is flush with the deck, and the latch 476 occupies the notches 464 in the pulley 460. As a result, the pulley 460 cannot rotate, and the foot platforms 245 are locked against pivoting relative to the foot skates 241. The foregoing arrangement 470 is designed so that the locked mode can be activated before the platforms 245 are moved to similar elevations. In this regard, the spring 478 causes the latch 476 to bear against the upper flange 462 on the pulley 460 and to snap into the notches 464 as they rotate into alignment with the latch 476.

Among other things, the present invention may be described in terms of an exercise apparatus, comprising: a base; a left skate mounted on said base and movable backward and forward relative to said base; a right skate mounted on said base and movable backward and forward relative to said base; a first locking means for selectively locking each said skate against movement relative to said base; a rigid left foot support pivotally connected to said left skate, wherein said left foot support includes a foot platform; a rigid right foot support pivotally connected to said right skate, wherein said right foot support includes a foot platform; and a second locking means for selectively locking each said foot support against movement relative to a respective skate. Said first locking means may include a pin which is selectively movable through aligned holes in said base and at least one said skate, and/or said second locking means may include a pin which is movable through aligned holes in at least one said foot support and a respective skate. Said left skate and said right skate may be interconnected by a flexible connector which is routed about at least a first pulley on said base, and said first locking means may selectively lock said first pulley against rotation relative to said frame, and/or said left foot platform and said right foot platform may interconnected by another flexible connector which is routed about at least a second pulley on said base, and said second locking means may selectively constrain said first pulley and said second pulley to rotate together relative to said frame. Each said locking means may include a common rod having a non-circular cross section. Alternatively, said first locking means may include pinion driven racks which are selectively movable through aligned holes in said base and each said skate, and/or said second locking means may include a toggle which is selectively movable into engagement with a pulley which is linked to both of the skates. In any event, each said foot support may be L-shaped, and each said foot platform may be rigidly mounted on a first distal end of a respective foot support. An opposite, second distal end of each said foot support may be connected to a flexible connector routed about at least one guide on said base, and/or each said foot support may be pivotally connected to a respective skate proximate an intermediate juncture between said first distal end and said second distal end. The apparatus may further comprise a left resistance means and a right resistance means, each interconnected between a respective second distal end and a respective skate, for resisting downward pivoting of a respective foot platform relative to a respective skate.

Although the subject invention has been described with reference to specific embodiments and particular applications, there are additional embodiments, combinations, modifications, and applications which fall within the scope of the present invention. Among other things, rigid interconnecting rods may be substituted for the cables and pulleys shown in and described with reference to the figures; different resistance arrangements and/or motion selecting means may be used; a manually operated rod may be substituted for the remotely controlled adjustment member 282; and/or the features of various assemblies and/or embodiments may be mixed and matched. Recognizing that the foregoing description sets forth only some of the numerous possible modifications and variations, the scope of the present invention is to be limited only to the extent of the claims which follow.

What is claimed is:

1. An exercise apparatus, comprising:

a base;

a left skate mounted on said base and movable backward and forward relative to said base;

a right skate mounted on said base and movable backward and forward relative to said base;

a rigid left foot support pivotally connected to said left skate and including a foot platform which is constrained to move through an arcuate path relative to said left skate;

a rigid right foot support pivotally connected to said right skate and including a foot platform which is constrained to move through an arcuate path relative to said right skate; and a frame configured to rest on a floor surface, wherein a first end of said base is pivotally connected to said frame and supported above said floor surface by said frame, and an opposite, second end of said base is selectively pivotal into and out of contact with said floor surface, and said frame is configured to accommodate said base and each said foot support when said base is pivoted to a generally vertical orientation relative to said floor surface.

2. The exercise apparatus of claim 1, further comprising a linking means, interconnected between each said skate, for linking said left skate and said right skate to move in reciprocal striding fashion relative to one another.

3. The exercise apparatus of claim 1, further comprising a linking means, interconnected between each said foot support, for linking said left foot support and said right foot support to move in reciprocal stepping fashion relative to one another.

4. The exercise apparatus of claim 1, further comprising a locking means for selectively locking each said foot platform against movement relative to a respective skate.

5. The exercise apparatus of claim 1, further comprising a locking means for selectively locking each said foot skate against movement relative to said base.

6. The exercise apparatus of claim 1, further comprising a left resistance means and a right resistance means, each interconnected between a respective foot platform and a respective skate, for resisting downward movement of a respective foot platform relative to a respective skate, wherein each said resistance means gains in mechanical advantage as a respective foot platform moves toward a respective skate.

7. The exercise apparatus of claim 1, wherein said base defines a deck, and each said skate is disposed beneath said deck, and a respective portion of each said foot support extends through a respective slot in said deck.

8. The exercise apparatus of claim 1, further comprising complementary latch components on said frame and said base for selectively latching said base in said generally vertical orientation relative to said frame.

9. The exercise apparatus of claim 1, further comprising a biasing means, interconnected between said frame and said base, for biasing said base over center between said generally vertical orientation and a generally horizontal orientation.

10. The exercise apparatus of claim 1, further comprising a flywheel rotatably mounted on said base, proximate said first end, and linked to rearward movement of each said foot skate.

11. An exercise apparatus, comprising:

a base including a deck which defines a support surface and a left slot and a right slot;

a left skate mounted on said base beneath said deck and movable backward and forward relative to said base;

a right skate mounted on said base beneath said deck and movable backward and forward relative to said base;

a rigid left foot support pivotally connected to said left skate, wherein said left foot support includes a foot platform disposed above said deck, and a portion of said left foot support extends through said left slot; and a rigid right foot support pivotally connected to said right skate, wherein said right foot support includes a foot platform disposed above said deck, and a portion of said right foot support extends through said right slot.

12. The exercise apparatus of claim 11, further comprising a linking means, disposed beneath said deck and interconnected between each said skate, for linking said left skate and said right skate to move in reciprocal striding fashion relative to one another.

13. The exercise apparatus of claim 11, further comprising a linking means, disposed beneath said deck and interconnected between each said foot support, for linking said left foot support and said right foot support to move in reciprocal stepping fashion relative to one another.

14. The exercise apparatus of claim 11, further comprising a locking means for selectively locking each said foot platform against movement relative to a respective skate.

15. The exercise apparatus of claim 11, further comprising a locking means for selectively locking each said foot skate against movement relative to said base.

16. The exercise apparatus of claim 11, further comprising a left resistance means and a right resistance means, each disposed beneath said deck and interconnected between a respective foot platform and a respective skate, for resisting movement of a respective foot platform relative to a respective skate.

17. The exercise apparatus of claim 16, wherein each said resistance means is disposed beneath a respective skate.

18. The exercise apparatus of claim 11, wherein each said foot support is L-shaped.

19. The exercise apparatus of claim 11, further comprising a floor engaging frame pivotally connected to an end of said base, wherein said base is pivotal between an operative orientation and a storage orientation relative to said frame.

20. The exercise apparatus of claim 19, further comprising a biasing means, interconnected between said frame and said base, for biasing said base over center between said operative orientation and said storage orientation.

21. An exercise apparatus, comprising:

a base;

a left skate mounted on said base and movable backward and forward relative to said base;

a right skate mounted on said base and movable backward and forward relative to said base;

a rigid left foot support including a first distal portion configured to support a person's foot, a second distal portion, and an intermediate portion pivotally connected to said left foot skate;

a left resistance means interconnected between said left skate and said second distal portion of said left foot support in such a manner that said left resistance means gains mechanical advantage relative to said left foot support as said left foot support moves downward relative to said left skate;

a rigid right foot support including a first distal portion configured to support a person's foot, a second distal portion, and an intermediate portion pivotally connected to said right foot skate; and a right resistance means interconnected between said right skate and said second distal portion of said right foot support in such a manner that said right resistance means gains mechanical advantage relative to said right foot support as said right foot support moves downward relative to said right skate.

22. The exercise apparatus of claim 21, wherein a left rocker is pivotally mounted on said left skate and pivotal about a left rocker axis, and a right rocker is pivotally mounted on said right skate and pivotal about a right rocker axis, and each said rocker is operatively connected to said second distal portion of a respective foot support, and a separate resistance device is interconnected between each said rocker and a respective skate.

23. The exercise apparatus of claim 22, wherein each said rocker and a respective resistance device define a second pivot axis, and each said resistance device and a respective skate define a third pivot axis, and each said second pivot axis moves away from a line drawn between a respective rocker axis and a respective third pivot axis as a respective foot platform moves downward relative to a respective skate.

24. The exercise apparatus of claim 23, wherein a separate connector link is pivotally interconnected between a respective rocker link and said second distal portion of a respective foot support, and each said connector link and a respective rocker link define a fourth pivot axis, and each said connector link and a respective foot support define a fifth pivot axis, and each said fourth pivot axis moves toward a line drawn between a respective rocker axis and a respective fifth pivot axis as a respective foot platform moves downward relative to a respective skate.

25. The exercise apparatus of claim 22, wherein a separate connector link is pivotally interconnected between a respective rocker link and said second distal portion of a respective foot support, and each said connector link and a respective rocker link define a second pivot axis, and each said connector link and a respective foot support define a third pivot axis, and each said second pivot axis moves toward a line drawn between a respective rocker axis and a respective third pivot axis as a respective foot platform moves downward relative to a respective skate.

26. The exercise apparatus of claim 21, further comprising a linking means, interconnected between each said second distal portion, for linking said left foot support and said right foot support to move in reciprocal stepping fashion relative to one another.

27. The exercise apparatus of claim 26, further comprising another linking means, interconnected between each said skate, for linking said left skate and said right skate to move in reciprocal striding fashion relative to one another.

28. The exercise apparatus of claim 21, further comprising a locking means for selectively locking each said foot platform against movement relative to a respective skate.

29. The exercise apparatus of claim 21, further comprising a locking means for selectively locking each said foot skate against movement relative to said base.

30. The exercise apparatus of claim 21, wherein each said resistance means is disposed beneath a respective skate.

31. An exercise apparatus, comprising:

a base;

a left skate mounted on said base and movable backward and forward relative to said base;

a right skate mounted on said base and movable backward and forward relative to said base;

a rigid left foot support including a first distal portion sized and configured to support a person's foot, a second distal portion, and an intermediate portion pivotally connected to said left foot skate;

a rigid right foot support including a first distal portion sized and configured to support a person's foot, a second distal portion, and an intermediate portion pivotally connected to said right foot skate; and at least one flexible connector interconnected between said second distal portion of said right foot support and said second distal portion of said left foot support, and routed about at least one guide on said base in a manner which constrains said left foot platform and said right foot platform to pivot upward and downward in coordinated dependent fashion relative to said base, regardless of where each said foot skate is positioned along said base.

32. The exercise apparatus of claim 31, wherein said left skate and said right skate are constrained to move forward and rearward in coordinated dependent fashion relative to said base.

33. The exercise apparatus of claim 31, further comprising means for selectively preventing pivoting of said foot supports relative to respective foot skates.

34. The exercise apparatus of claim 31, further comprising means for selectively preventing movement of said foot skates relative to said base.

35. The exercise apparatus of claim 31, wherein said at least one flexible connector is operatively connected to a flywheel.

36. The exercise apparatus of claim 31, wherein each said foot support is L-shaped.

37. The exercise apparatus of claim 31, further comprising a separate resistance device interconnected between each said second distal portion and a respective foot skate, wherein each said resistance device gains mechanical advantage relative to a respective foot support as said respective foot support moves downward relative to said respective skate.

38. The exercise apparatus of claim 37, wherein each said resistance device includes a rocker link pivotally mounted on a respective foot skate and interconnected between a respective second distal portion and a respective telescoping member.

39. The exercise apparatus of claim 31, wherein said base includes an upwardly facing deck, and each said skate is disposed beneath said deck, and each said foot support extends through a respective slot in said deck, and each said first distal portion is disposed above said deck.

40. The exercise apparatus of claim 39, wherein a separate resistance device is interconnected between each said second distal portion and a respective foot skate; a connector is interconnected between each said second distal portion and routed about at least one guide on said base; and a connector is interconnected between said left foot skate and said right foot skate and routed about at least one guide on said base.

* * * * *